United States Patent [19]

Lattion et al.

[11] Patent Number: 4,684,307

[45] Date of Patent: Aug. 4, 1987

[54] ARRANGEMENTS FOR HANDLING CONICAL THREAD PACKAGES

[75] Inventors: André Lattion, Seuzach; Alfred Carl; Reinhard Oehler, both of Winterthur, all of Switzerland

[73] Assignee: Maschinenfabrik Rieter AG, Winterthur, Switzerland

[21] Appl. No.: 677,175

[22] Filed: Dec. 3, 1984

[30] Foreign Application Priority Data

Dec. 2, 1983 [GB] United Kingdom ..... 8332252

[51] Int. Cl.[4] ..... B65G 47/24; B65G 57/22

[52] U.S. Cl. ..... 414/31; 198/395; 198/399; 198/430; 294/902; 294/907; 414/68; 414/110; 901/33

[58] Field of Search ..... 414/31, 68, 110; 198/394, 395, 399, 430, 400; 53/534, 544; 294/902, 907; 901/32, 33, 34, 35, 44, 46

[56] References Cited

U.S. PATENT DOCUMENTS

| | | | |
|---|---|---|---|
| 3,216,551 | 11/1965 | Peck | 198/395 |
| 3,306,442 | 2/1967 | Devol | 901/32 X |
| 3,513,959 | 5/1970 | Frehn | 198/395 |
| 3,592,001 | 7/1971 | Gross et al. | 53/534 X |
| 3,802,154 | 4/1974 | Dillon | 53/544 X |
| 3,838,292 | 9/1974 | Sullivan | 198/399 X |
| 3,878,665 | 4/1975 | Couten | 53/544 X |
| 3,934,716 | 1/1976 | Heckel | 198/395 |
| 3,981,551 | 9/1976 | Miyazaki . | |
| 4,132,318 | 1/1979 | Wang et al. | 294/907 X |
| 4,396,335 | 8/1983 | Brandstetter et al. | 414/110 X |
| 4,530,430 | 7/1985 | Peterlini | 198/395 |
| 4,565,278 | 1/1986 | Asai et al. | 198/400 |

FOREIGN PATENT DOCUMENTS

| | | | |
|---|---|---|---|
| 17470 | 10/1980 | European Pat. Off. | 198/399 |
| 113125 | 7/1984 | European Pat. Off. | 198/395 |

*Primary Examiner*—Leslie J. Paperner
*Attorney, Agent, or Firm*—Michael J. Striker

[57] ABSTRACT

An arrangement for handling conical thread packages includes a sensing device which senses the orientation in which the package arrives on a main conveyor to a juncture with an accumulating auxiliary conveyor, and a manipulating device capable of gripping the package and reorienting it if needed to obtain the desired orientation of the package on the auxiliary conveyor. A removing device may be provided to engage a group of the packages accumulated with the desired orientation on the auxiliary conveyor and to transfer such group to a receiving conveyor in such a manner that the packages are deposited in the container in respective layers with orientations which are the same in each layer but opposite in directly superimposed layers.

29 Claims, 12 Drawing Figures

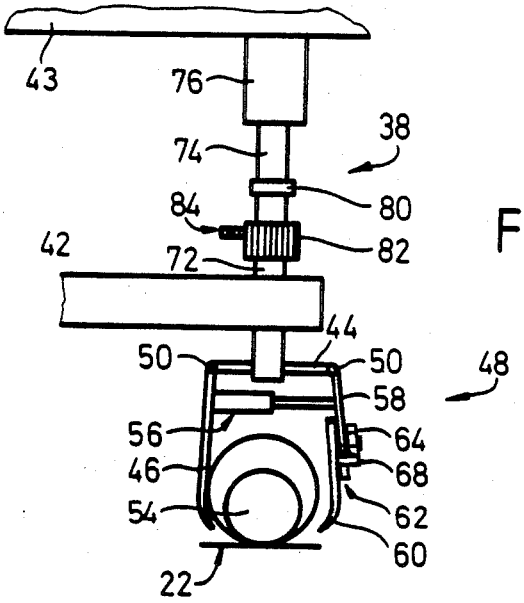
Fig. 3
Fig. 2
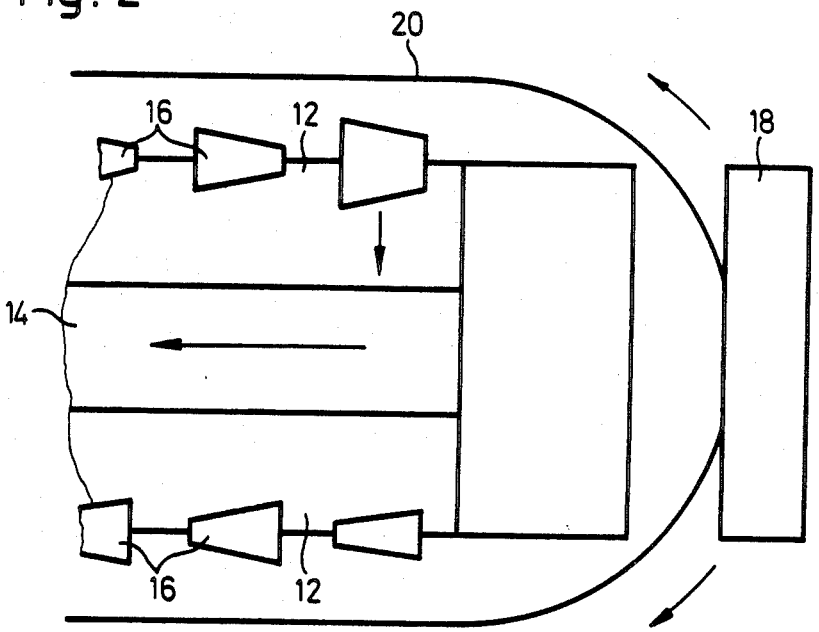

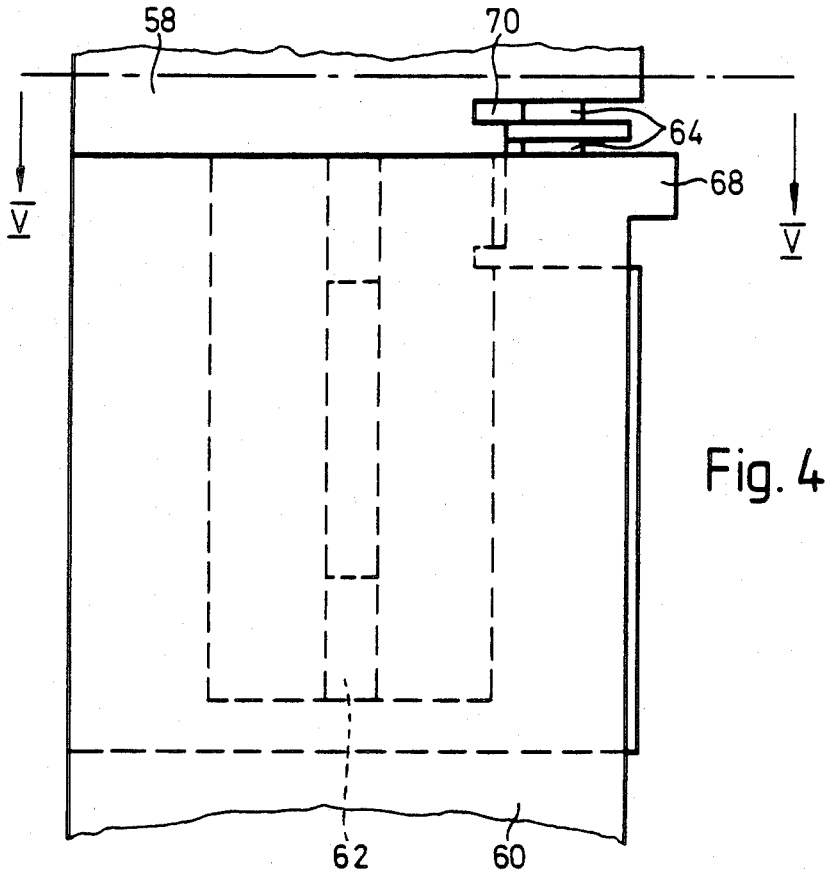
Fig. 4
Fig. 5
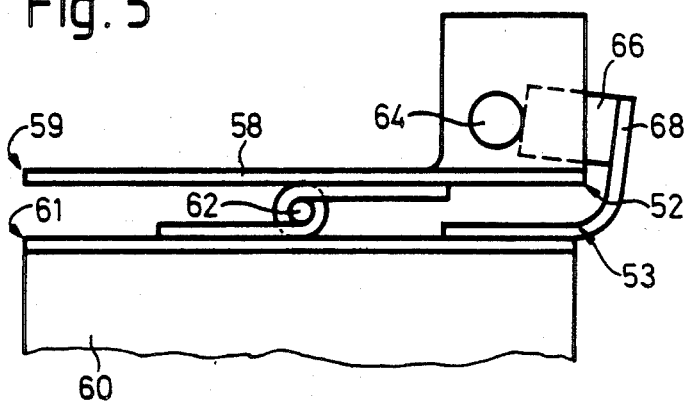

Fig. 7a
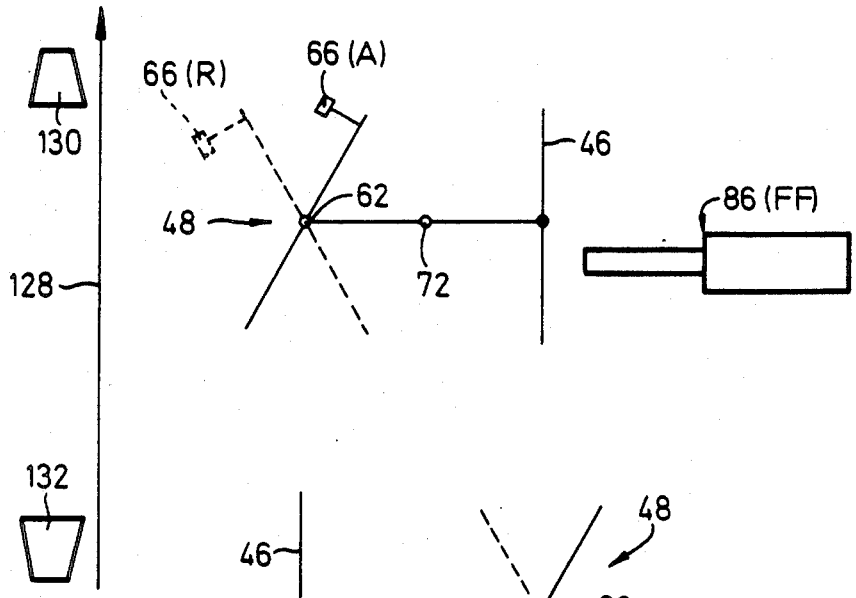
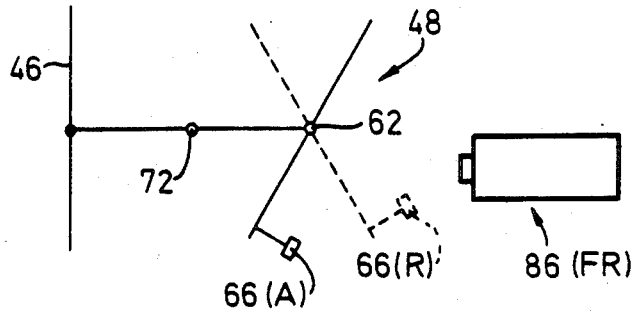
Fig. 7b
Fig. 8
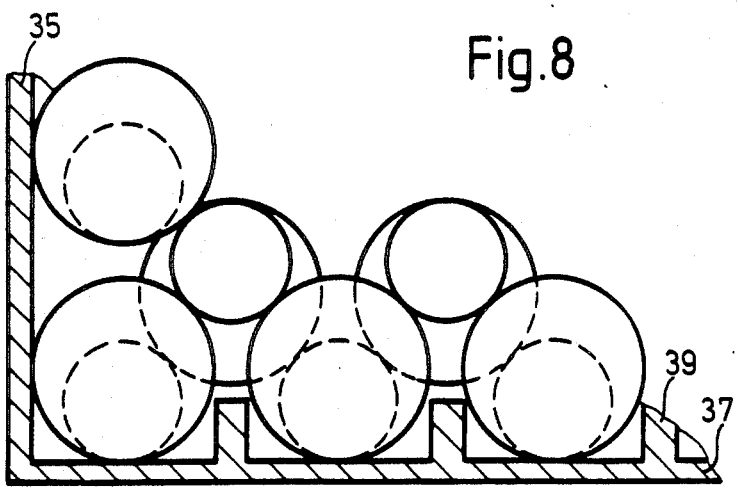

ARRANGEMENTS FOR HANDLING CONICAL THREAD PACKAGES

BACKGROUND OF THE INVENTION

The present invention relates to the handling of articles capable of assuming distinguishable orientations in general, and more particularly to the handling of conical thread packages such as those produced by spinning machines or winding machines.

Various constructions of arrangements for handling thread packages have already been proposed. So, for instance, in the U.S. patent application Ser. No. 510,557, now U.S. Pat. No. 4,558,776, there is described and claimed an apparatus for arranging cross-wound thread packages. That application is concerned in particular with the control of conveyor belt arrangements upon which the thread packages are being conveyed. Such a control system provides for the accumulation of a group of packages in a predetermined array while avoiding disturbances in the outer layers of the accumulated packages which are otherwise commonly encountered and are caused by relative movement between the respective package and a conveyor belt on which the package rests, by accumulating the array on an intermittently operated auxiliary conveyor belt. The full disclosure of this earlier application is incorporated herein by reference.

Although the invention of the aforementioned earlier application is not limited to use with cylindrical packages ("cheeses"), the embodiments actually illustrated in this earlier applications were all designed for handling such cylindrical packages, and would create possibly insurmountable problems if used to handle conical thread packages ("cones") without modification. In any event, this earlier application contains no suggestions how the principles of of construction and operation disclosed therein could be used to handle conical thread packages.

SUMMARY OF THE INVENTION

Accordingly, it is a general object of the present invention to avoid the disadvantages of the prior art.

More particularly, it is an object of the present invention to provide an arrangement for handling articles, especially thread packages, which can assume distinguishable opposite orientations, which arrangement does not possess the disadvantages of similar arrangements known in the art.

Still another object of the present invention is to come up with modifications and developments especially designed to convert the above-discussed handling arrangement to use with conical thread packages or other reorientable objects or articles.

It is yet another object of the present invention so to construct the arrangement of the type here under consideration as to require only a minimum amount of human intervention during its operation.

A concomitant object of the present invention is so to design the arrangement of the above type as to be simple in construction, inexpensive to manufacture, easy to use, and reliable in operation nevertheless.

In pursuance of these objects and others which will become apparent hereafter, one feature of the present invention resides in an arrangement for handling articles, especially thread packages, which are so configurated as to permit distinguishing between at least two opposite orientations thereof, this arrangement comprising main conveyor means for conveying the articles in a predetermined direction in a conveying path such that each article arrives at the downstream end of the main conveyor means with an arbitrary orientation at least of the opposite ones; auxiliary conveyor means arranged at the downstream end of the main conveyor means for receiving the articles in succession from the main conveyor means; means for sensing the orientation of the articles at the juncture of the main and auxiliary conveyor means; and means for manipulating any article whose orientation at the juncture as sensed by the sensing means deviates from that which such article is to assume on the auxiliary conveyor means downstream of the manipulating means to give such improperly oriented article the desired orientation Advantageously, the auxiliary conveyor means is arranged to form a continuation of the main conveyor means in the predetermined direction, and the sensing means forms a part of the manipulating means. The auxiliary conveyor means is operatable as an accumulator to group the articles transferred to the auxiliary conveyor means. Removing means can be provided for removing a group of packages from the auxiliary conveyor means so that the auxiliary conveyor means can receive further packages from the main conveyor means. The removing means may be adapted to move the group of packages or articles to a predetermined location remote from the conveyor mean, at which location the articles can be transferred to a suitable receiving means therefor when such receiving means is brought into an operative relationship with the removing means. Means is provided at the junction of the main and auxiliary conveyor means to sense the orientation of the conical package or article arriving at the junction, and to change the article orientation if required to ensure that each article in a group on the auxiliary conveyor means has a predetermined orientation.

Each group formed on the auxiliary conveyor means preferably comprises a predetermined number of the articles arranged in a row. In principle, the system could be operated so that the individual packages of the given group would have different orientations, respectively. Preferably, however, the arrangement is operated so that all articles in a given group have the same orientation. The predetermined desired orientation is nevertheless preferably selectable so that successive groups can be arranged to have respective different orientations.

The means for sensing the orientation of the package or article and for manipulating the latter to give it the desired orientation is preferably arranged to respond to and act on an article on the auxiliary conveyor means at a region of the latter which is situated adjacent the main conveyor means.

The handling arrangement may further include means for controlling movement of a package receiving container relative to the removing means. For instance, the arrangement may comprise a selectably operatable moving means and a releasably connecting deice for selectively coupling the moving means with the respective package or article receiving container. Control and monitoring means may further be included in accordance with the present invention so that the arrangement automatically responds to predetermined events in order to fill the respective package or article receiving container in an ordered and controlled manner with the articles or packages arriving at the handling arrangement in an order which is beyond the control of the handling arrangement and hence cannot be determined by the latter.

In accordance with another aspect of the present invention, there is provided an orienting device for conical articles. It is to be understood that the expression "conical" as used in this application is to be construed to include "frusto-conical". The articles handled by the orienting device may be thread packages, but it will be appreciated that this aspect of the present invention is not limited to its use with thread packages, or even to its use with articles encountered in the textile industry. The orienting device includes at least two article-engaging elements or members mounted for relative movement to form an openable and closable article gripper, and means for rotating the gripper about an axis transverse to the directions of the opening and closing movements of the article-engaging members. At least one of the article-engaging members includes at least a portion which is mounted for movement between a first and a second disposition relative to the remainder of the gripper, the part being in a first disposition when the gripper closes on a conical article oriented in one direction and in the second disposition when the gripper closes on a conical article oriented in the opposite direction. Sensor means is provided to sense the disposition of the movable part or portion.

The gripper may comprise a carrier; and the first and second article-engaging members or elements may be pivotally mounted on the carrier to enable opening and closing of the gripper. The carrier may be rotatable to enable rotation of the gripper about an axis transverse to the opening and closing movements of the article-engaging members. Preferably, the gripper is movable linearly along the rotation axis between first and second positions to enable raising of an article held in the gripper prior to the rotation thereof and lowering of the article onto the support after the gripper has rotated the article into its desired orientation. The movable portion or part of the gripper may be pivotable about second axis transverse to the opening and closing movements of the article-angaging members of the gripper.

In accordance with another facet of the present invention, there is provided a package or article removing means for removing the respective article or package from a support on which the article initially rests. The removing means includes an openable and closable package gripper and means for raising and lowering the gripper along a path displaced to one side of the support. A pivot mounting arrangement enables pivoting of the gripper relative to the raising and lowering means. There is further provided moving means for pivoting the gripper on its mounting arrangement to engage the respective package on the support from below and to one side to enable the gripper to grasp the package or article for lifting the same clear of the support. The moving means may include abutment means engageable by the gripper during its downward movement along the aforementioned path so that, during further continued movement of the gripper downwardly along the path, the gripper is guided or deflected under the respective package resting on the support by the abutment or hindering action of the abutment means.

The novel features which are considered as characteristic of the invention are set forth in particular in the appended claims. The improved article handling arrangement itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a top plan view of another part of the machine which is remote from the package handling arrangement of FIG. 1;

FIG. 3 is a front elevational view of a package-orienting device according to the present invention; FIG. 4 is a side elevational view of a part of the device of FIG. 3;

FIG. 5 is a sectional view taken on line V—V of FIG. 4;

Figure 6:
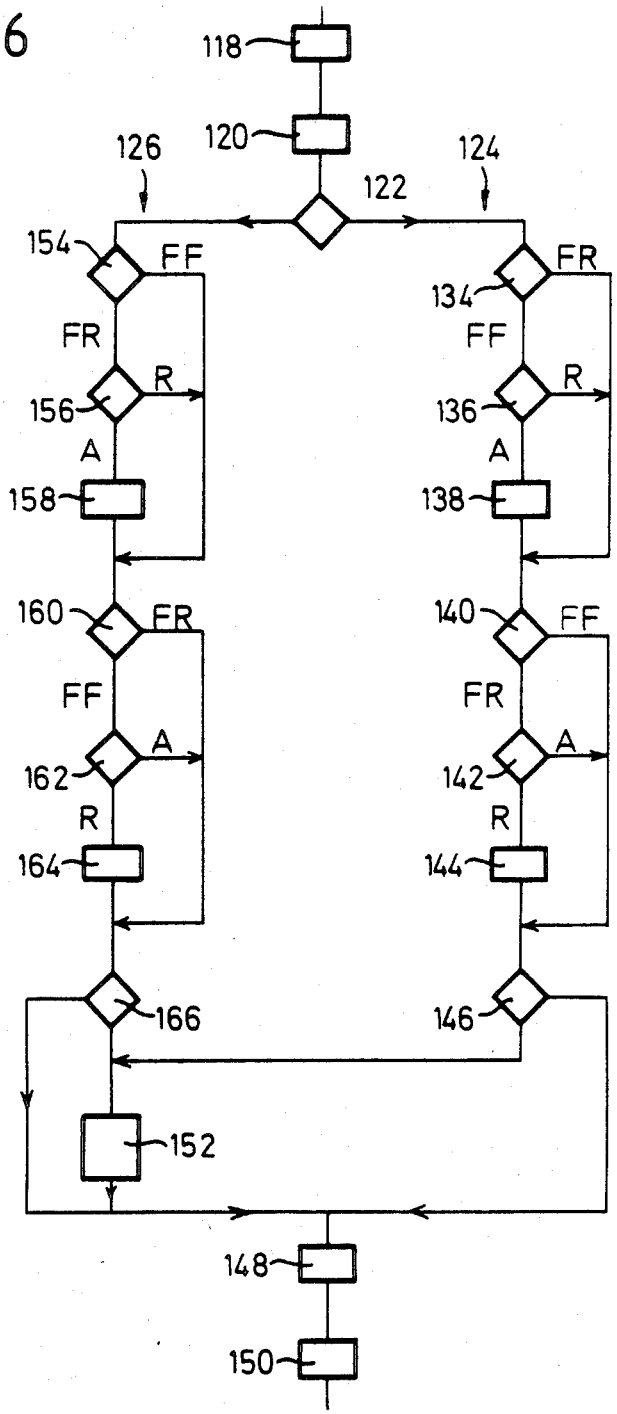
FIG. 6 is a flow chart of one form of a control operation for the device of FIGS. 3 to 5.

FIGS. *7a* and *7b* are diagrammatic representations for use in explanation of FIG. 6;

FIG. 8 is a sectioned side elevational view of one end part of a package-receiving container with a plurality of the packages already deposited therein; and FIGS. *9a*, *9b*, and *9c* are diagrammatic representations indicating the movements of the package-removing means.

DETAILED DESCRIPTION OF THE PREFERRED EMBODIMENTS

Figure 1:
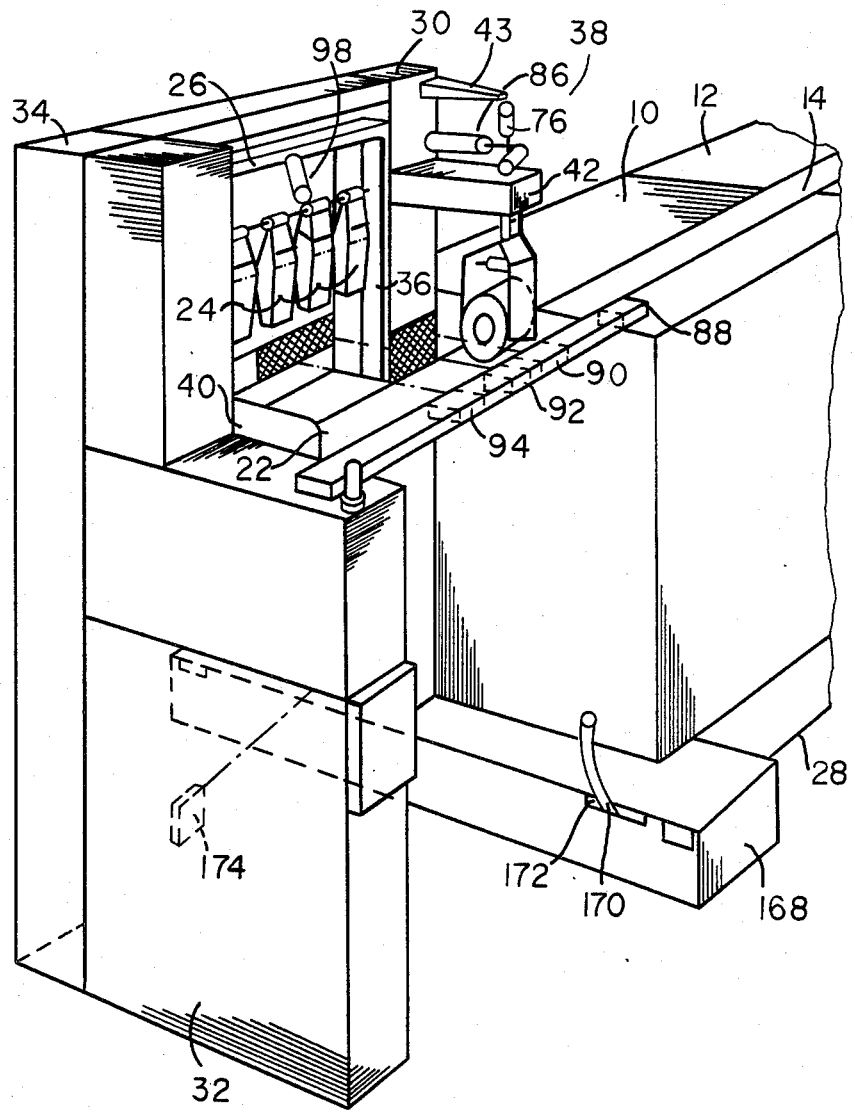
FIG. 1 is a perspective view of an end section of a machine used in the textile industry which is equipped with a package-handling arrangement of the present invention.

Referring now to the drawing in detail, and first to FIG. 1 thereof, it may be seen that the reference numeral 10 has been used to identify an end unit of an elongated package winding machine for use in the textile manufacturing industry. The end part 10 has been illustrated in a diagrammatic fashion only as a block. A downstream part of a main body of the machine is indicated, also in a diagrammatic manner at 12. Details of the winding machine itself are not important for understanding the present invention, and thus have been omitted. The package winding machine could be, for instance, a spinning machine, such as a rotor spinning machine of the type shown in U.S. Pat. No. 3,511,045. Alternatively the machine could be a back winding machine, for example, of the type shown in the U.S. Pat. No. 4,154,411. As another alternative the machine could be a false twist texturizing machine, such as that shown in U.S. Pat. No. 3,811,631.

Only three features of the machine itself are of significance in relation to this invention, namely, that the machine includes a conveyor belt 14 extending in the longitudinal direction of the machine over substantially the entire length of the latter, the conveyor belt 14 being operative for carrying thread packages to the illustrated downstream end of the machine that the machine is of the type producing conical (that is frusto-conical) thread packages, and that the arrangement is such that some of the thread packages are deposited on the belt 14 with their smaller ends forward (considered in the conveying or downstream direction) while others are deposited with their larger ends forward.

By way of example only, FIG. 2 shows diagrammatically an arrangement which possesses the above features. The top plan view of FIG. 2 shows the upstream end of the machine, that is, the end opposite to that illustrated in FIG. 1. The machine is of the twosided type with a large number of independently operatable thread processing stations arranged in two rows on opposite sides of the machine. Each processing station includes its own thread-packageforming section capable of successively forming conical packages 16. When the package at one of the processing stations is full, it is transferred to the belt 14 and transported thereby to the downstream end of the machine which is shown in FIG. 1. The transfer of the full package from the processing station to the conveyor belt 14 is effected by a travelling doffer 18 movable on a U-shaped rail 20 into alignment with any selected one of the processing stations. During formation of the package, the longitudinal package axis is disposed parallel to the longitudinal direction of the machine, and hence to the longitudinal direction of the belt 14. For convenience in design of the doffer 18, however, the processing stations on one machine side are arranged so that the packages 16 formed thereat are oriented with their smaller ends pointing towards the right as seen in FIG. 2, while the processing stations on the other machine side are so arranged that the packages 16 formed thereat are oriented with their smaller ends pointing towards the left as viewed in FIG. 2. Furthermore, in order to avoid complications in the design of the doffer 18, the orientation of the respective package 16 is not changed during its transfer between the processing station and the belt 14. Finally, the machine operates on the random doffing principle so that the processing stations are not doffed in a predetermined sequence. Accordingly, the package handling system shown in FIG. 1 has no effective control over the orientation of an incoming package; thus the package may be oriented with either its smaller end or its larger end facing longitudinally of the belt 14 towards the downstream machine end shown in FIG. 1.

The handling system itself is similar to that disclosed and claimed in the U.S. patent application Ser. No. 510,557. For the sake of completeness of the present description, a brief outline of that system will be repeated here, but full details can be obtained from the prior application.

The handling system comprises an auxiliary conveyor belt 22, which is longitudinally aligned with and forms an extension of the belt 14. The belt 22 is selectively operatable by means of a control system which will be described in detail later, in order to line-up four thread packages 16 in a row with a predetermined spacing between the packages 16. When so arranged, the four packages 16 can be removed simultaneously by removal means comprising four package gripping devices 24. The gripping devices 24 are adapted to close around respective thread packages 16 grouped on the belt 22, and they are carried by a common frame member 26 so that they are movable simultaneously to lift the packages 16 from the belt 22 and to move them to one side of the belt 22.

The aforementioned earlier application describes a control system for controlling the operation of the belt 22. This known control system enables the operation of the belt 22 for only a short period of time following the arrival of an incoming package 16 thereon so as to move that package 16 through approximately one bobbin length away from the junction of the main and auxiliary belts 14 and 22. This renders it possible to form a row of the packages 16 with a predetermined spacing between the adjacent packages 16 but without slippage between the belt 22 and the outer windings on the packages 16 supported thereby. Full details of that control system can be obtained from the mentioned earlier application. Modifications of the control system enabling its use in the present invention will be described later in the present specification. Alternative control systems for use with the present invention will be described with reference to the drawings.

As is apparent from FIG. 1, the conveyor belt 14 of the winding machine is located well above ground level indicated at 28 The auxiliary belt 22 forms a horizontal extension of the belt 14, and for this purpose is supported by a bridge structure comprising a support pier 32 spaced from the end unit 10 of the winding machine and a bridging frame (not illustrated) extending between the end unit 10 and the support pier 32. The bridging frame carries the belt 22. A package-receiving carriage, which is not shown in FIG. 1, can be moved in directions indicated by a double headed arrow in FIG. 1 through the space present between the pier 32 and the machine end unit 10. As will be described below, the packages 16 removed from the belt 22 are to be positioned in an orderly fashion in the receiving carriage which is controllably located in relation to the bridge structure.

The bridge structure further comprises two columns 30, 34 respectively, the column 30 being associated with the machine end unit 10 and the column 34 being associated with the pier 32. The columns 30 and 34 are located to one side of the bridging frame carrying the belt 22, and the columns 30 and 34 support between them the frame 26 which has been referred to above. At their surfaces facing toward each other, the columns 30 and 34 are provided with respective vertical slots 36, only the slot 36 of the column 30 being visible in FIG. 1. The frame 26 is movable along these slots 36 by moving means arranged within the columns 30 and 34 between its upper and lower limit positions, the frame 26 being illustrated in its upper limit position in FIG. 1. The slots 36 extend sufficiently far down along the columns 30 and 34 to enable lowering of the gripping devices 24 into the interior of the respective package-receiving carriage suitably located relative to the bridge structure.

In order to obtain efficient utilization of each package-receiving carriage, it is desired to lay the packages therein in a specific, ordered pattern which will now be described. The packages are to be arranged in horizontally disposed layers, each layer comprising a plurality of parallel rows of packages. The exact number of rows in each layer depends upon the acceptable dimensions of the carriage and can be selected in accordance with the requirements of the machine user. In the illustrated case, there are preferably four packages in each row, corresponding with the capacity of the belt 22 and the corresponding number of the gripping devices 24. Each row of a respective upper layer of packages 16 rests on two adjacent rows of the respective layer situated underneath the same. The ends of the packages 16 in the respective upper layers are substantially axially aligned with the ends of the packages 16 below them, so that four walls of the packages are built up, each wall extending in the longitudinal direction of the carriage and transverse to the rows. FIG. 8 shows a part of two layers of one such wall, the carriage end wall and bottom wall being indicated at 35 and 37 respectively. The bottom wall 37 has partitions 39 to space the rows of the lowermost layer. All packages 16 in any given layer have the same orientation, that is all conical packages 16 in the layer converge in the same direction. However, the packages 16 of superimposed layers have opposite orientations. Thus, the larger end of a package 16 in an upper layer rests on the smaller ends of two packages 16 in the layer below it and supports the smaller ends of two packages 16 in the layer (if any) above it.

Now, the implications of this required pattern for the handling system shown in FIG. 1 will be considered. As already described, the incoming packages arriving at the handling system on the belt 14 have a random orientation at least as far as the handling system is concerned. These randomly oriented packages 16 have to be ordered for laying in the carriage in the pattern described above. In accordance with the invention, a package orientation sensing and changing device 38 is provided at the junction of the main and auxiliary belts 14 and 22. In the embodiment illustrated in FIG. 1, the upper run of the belt 22 can be considered to be divided into an accumulating zone and a sensing zone. The accumulating zone is long enough to permit formation of a row of four packages 16 in alignment with respective gripping devices 24. The downstream end of this zone is delimited by an upstanding stop 40 at that end of the belt 22 which is remote from the belt 14. The sensing zone is located between the accumulating zone and the end unit 10, in alignment with the column 30. The sensing and changing device 38 is associated with this sensing zone, being supported by frame elements 42, 43 secured to the column 30. As will be described in detail presently, the arrival of an incoming package 16 at the sensing zone is detected and the device 38 is operated initially to sense the orientation of the newly arrived package 16. The sensed orientation is compared with a desired orientation determined by the control system. If actual orientation is the same as the desired orientation, then the belt 22 is operated to move the package 16, from the sensing zone to the accumulating zone. If the actual orientation is the reverse of the desired orientation, then the device 38 is further operated so as to lift the newly arrived package 16 slightly away from the belt 22 and rotate it through 180 degrees into the desired orientation. The package 16 is then lowered back onto the belt 22, which is then operated to move the re-oriented package 16 into the accumulating zone. The desired orientation is selectively variable in accordance with a predetermined program in order to produce the lay-down pattern described above. The mechanical construction of the device 38 will now be described with reference to FIGS. 3 to 5. The device 38 comprises a carrier member 44 and a pair of package engaging arms 46 and 48 respectively. Each arm 46, 48 is connected to the carrier 44 by a respective pivot mounting arrangement 50 mounting the respective arm 46 or 48 for pivotal movement about an axis parallel to the longitudinal direction of the belt 22 and thus substantially parallel to the longitudinal axis of the respective package 16 which has just arrived in the sensing zone. The arms 46 and 48 are joined by a double acting cylinder-and-piston unit 56 selectively operatable to move the lower ends of the arms 46 and 48 towards and away from each other during the pivoting of the arms 46 and 48 about their mounting arrangements 50. The arm 46 is formed in one piece and extends downwardly from its pivot mounting arrangement 50 and is slightly curved, so that, when the arms 46 and 48 are moved towards one another by the unit 56, the lowermost portion of the arm 46 can make a contact with the underside of the package 16, i.e. the side facing the belt 22. The arm 48 is of similar overall length as the arm 46 and extends in a similar manner away from its respective pivot mounting arrangement 50. However, the arm 48 is divided into an upper portion 58 connected to the pivot mounting arrangement 50 and a lower, curved package-engaging portion 60 pivotally mounted on the portion 58 by a pivot mounting arrangement 62. The pivot axis defined by the pivot mounting arrangement 62 extends parallel to the plane of the upper arm portion 58 and at a right angle to the pivot axis of the mounting arrangement 50. The arm portion 60 is free to pivot on the mounting arrangement 62 relative to the arm portion 58 between a first position in which its edge 61 (FIG. 5) contacts or is close to an edge 59 of the arm portion 58 and a second position in which its region 53 contacts or is close to another edge 52 of the arm portion 58. The portion 60 will be forced into its first position when the arms 46 and 48 close on a package 16 oriented as shown in FIG. 3, that is with the smaller package end located adjacent the edges 52 and 53. The arm portion 60 will be forced into its second position relative to the portion 58 when the arms 46 and 48 close on an package 16 with the reverse orientation relative to the unit 38.Sensing means is provided to sense whether the portion 60 is in its first or its second position relative to the portion 58. As illustrated, this sensing means comprises a proximity sensor 64 fixedly mounted on the outwardly facing surface of the arm portion 58. The position sensing means further comprises an indicator element 66 (FIG. 5) secured to the arm portion 60 by means of a support portion 68 extending through a suitable opening 70(as shown in FIG. 4) in the arm portion 58. When the arm portion 60 is in its first position, the indicator element 66 is spaced from the proximity sensor 64 which reacts to the absence of the indicator element 66 from its neighborhood to indicate the first position. When the arm portion 60 is in its second position, the indicator element 66 is moved to a position under the proximity sensor 64, which reacts to the presence of the indicator element 66 to register the second position. The proximity sensor 64 generates suitable output signals which are fed to the control system to be described further below. The carrier 44 is fixedly secured to a shaft 72 rotatably guided in the support 42 referred to above. The shaft 72 is secured to a rod 74 connected to a piston (not shown) of a cylinder-and-piston unit, the cylinder of which is indicated at 76. The cylinder 76 is secured to the arm 43 which is fixedly mounted on the column 30 above the support 42 (see FIG. 1). As shown in FIG. 3, a coupling 80 is provided between the connecting rod 74 and the shaft 72. The coupling is of such a construction that the shaft 72 is vertically movable in accordance with the movements of the piston rod 74 longitudinally of the cylinder 76, but the shaft 72 is free to rotate relative to the rod 74 about a vertical axis extending longitudinally of the shaft 72 and the rod 74. Rotation of the shaft 72 at its coupling 80 can be effected by means of a gear wheel 82 secured to the shaft 72 above the support 42, and a gear segment 84 meshing with the gear wheel 82. The segment 84 is mounted (by means not shown) on the support 42 for pivotal movement about an axis parallel to the axis of the shaft 72. This pivotal movement of the segment 84 is effected by a selectively pressurizable cylinder-and-piston unit 86 secured at one end to the column 30 and at the other end to the gear segment 84 as shown in FIG. 1. The gear ratio between the segment 84 and the gear wheel 82 is such that one stroke of the cylinder-and-piston unit 86 corresponds to 180 degrees of angular displacement of the shaft 72 about its longitudinal axis. The operation of the device 38 is as follows:

The device is normally maintained in its open condition as shown in FIG. 3 in which the arms 46 and 48 are spread sufficiently far apart by the cylinder-and-piston unit 56 to enable an incoming package 16 to pass without difficulty into the sensing zone which lies between the arms 46 and 48 of the device 38. As soon as the package 16 is located in the sensing zone, between the arms 46 and 48,the belt 22 is stopped and the cylinder-and-piston unit 56 is actuated to close the arms 46 and 48 until they engage the package 16 firmly on respective, opposite sides thereof (this is the condition illustrated in FIG. 1). In this condition, the arm portion 60 will have been forced into its first or its second position about the mounting arrangement 62 relative to the portion 58 depending upon the orientation of the package 16. The control system yet to be described now carries out an interrogation operation (described later) to determine the orientation of the package 16 relative to the machine. The control system checks the result of the interrogation against the currently programmed desired orientation for the package 16. If the check indicates that the package 16 is in the desired orientation, the unit 56 is re-actuated to open the arms 46 and 48 and the belt 22 is restarted to move the package 16 from the sensing zone into the accumulating zone. If the check indicates that the package 16 is reversed relative to the desired orientation, a package reversal operation is carried out as will now be described.

The first step in the package reversal operation is pressurization of the cylinder-and-piston unit 76 so as to lift the shaft 72 and the carrier 44 slightly. The arms 46 and 48 are closed on the package 16 with a pressure sufficient to ensure that the package 16 is lifted with the arms 46 and 48 clear of the belt 22. The unit 86 is now operated so that the piston thereof travels through one full stroke thereof and thus rotates the shaft 72 through 180 degrees so that the orientation of the package carried by the arms 46 and 48 is reversed. The cylinder-and-piston unit 76 is now depressurized so that the package 16 is returned to the belt 22, the unit 56 is actuated to open the arms 46 and 48 and the belt 22 is operated to move the re-oriented package 16 into the accumulating zone. The unit 38 is immediately ready for the arrival of the next package 16, that is, it is not necessary to rotate the arms 46 and 48 back to a preset starting position, although the system could be designed to operate in that way. It will be appreciated that in principle each arm 46 and 48 could have a portion adjustable to the conicity of the packages 16 being handled. It is preferred, however, to force one arm only (arm 48 in the illustrated embodiment) to undertake all of the adjustment to the package conicity; this facilitates production of an unambiguous signal by the proximity sensor 64. It is not necessary to force the arm portion 60 to any particular starting position relative to the portion 58. The only significant position of the portion 60 for any particular sensing operation is its position after the arms have closed on the package 54.The control system mentioned before operates in response to an array of four detector 88, 90, 92 and 94 respectively ( FIG. 1). These detectors 88, 90, 92 and 94 are mounted to one side of the transport path defined by the belts 14 and 22, and each is designed to respond to the presence of a package 16 in the transport path in its immediate neighborhood. As illustrated, these detectors 88, 90, 92 and 94 are of the light barrier type, that is each is designed to emit a beam of light which, in the absence of a thread package 16 from the detecting zone of the detectors 88, 90, 92 or 94, passes across the transport path to a reflector arranged opposite the detector 88, 90, 92 or 94 and is reflected thereby back to the detector 88, 90, 92 or 94. The detector 88, 90, 92 or 94 responds to the interruption of this light barrier by passage of an interrupting object (a thread package 16) between the detector 88, 90, 92 or 94 and its reflector. The light beams emitted by the detectors 90, 92 and 94 respectively are indicated by dash-dotted lines in FIG. 1 and the respective reflectors are indicated by cross hatching. The reflector for the detector 88 cannot be seen in FIG. 1. The beam of the detector 88 is directed across the end of the belt 14. The detector 88 responds to arrival of a package 16 at the junction of belts 14 and 22 to cause start-up of previously stationary belt 22. The incoming package 16 is therefore moved away from the junction into the sensing zone, where its arrival is detected by the detector 90. The control system responds to detection of the package 16 by the detector 90 to carry out an orientation sensing operation and, if necessary, an orientation changing operation as described above. The control system will prevent restart of the belt 22 by the detector 88 until an already running orientation operation has been completed and the sensing zone has been cleared to become ready to receive the next package.

The operation of the device 38 is carried out in accordance with a programmed sequence which will be described later with reference to FIG. 6. After completion of this sequence, the properly oriented package 16 is immediately moved out of the sensing zone which is therefore free to receive the next following package 16. The latter may already lie waiting at the detector 88 or may arrive only after a delay—this is beyond the control of the package handling system. When this following package 16 enters the sensing zone, the operation of the device 38 is repeated and then the belt 22 is again started in order to clear the sensing of these movements of the belt 22, the first package 16 will reach the stop 40 and be held thereby in alignment with the downstream gripping device 24. In the course of movement of the fourth the package 16 of the group of four packages 16 into the sensing zone, the second package 16 will be brought into engagement with the first and will lie in alignment with the penultimate gripping device 24. The control system includes a counter (not shown) responsive to detection of four successive packages 16 by detector 88 in order to prevent transfer of any further packages 16 to the belt 22 until the now-accumulated group of four packages 16 is removed. Thus, after the completion of the operation of the device 38 on the fourth package 16, the belt 22 is re-started in order to close the third package 16 against the second and the fourth package 16 against the third, each package 16 now being in alignment with its respective gripping device 24.

The control system now interrogates the outputs of the detectors 92 and 94. Although not readily apparent from FIG. 1 due to perspective distortion, the beam of the detector 94 is aligned with the upstream gripping device 24 and responds to the presence of the fourth package 16 in alignment with that gripping device 24. The beam of the detector 92 is directed to pass between the fourth package 16 and the column 30. If a reflected light beam is received by the detector 92 at this stage, therefore, the signal from this detector 92 indicates that the four packages have been accumulated correctly and that a fifth package 16 has not penetrated the system by mistake and come to rest the fourth package 16. The correct combination of output signals of the detectors 92 and 94 triggers the operation of the removal means for removing the groups of accumulated packages 16 from the belt 22.

Figure 9A:
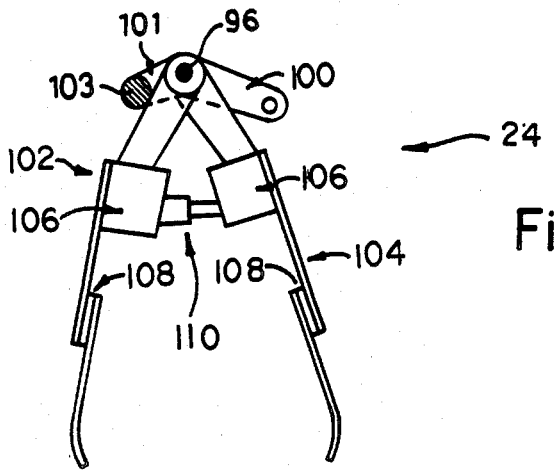
Figure 9B:
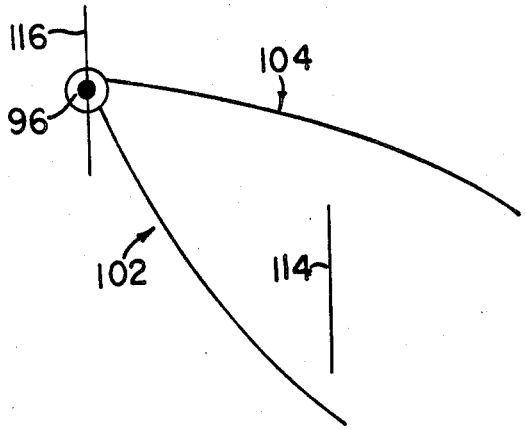
Figure 9C:
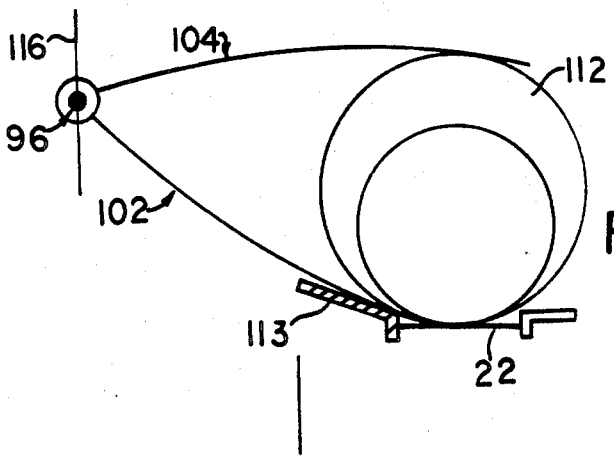

The operation of the gripping devices 24 in order to grasp their respective packages 16 on the belt 22 can be seen from the sequence of diagrams in FIG. 9. It will be understood, however, that this represents only a preferred embodiment of the removal means, and that the principles of orientation of the packages 16 can be used with removal systems other than that shown in FIG. 9. FIG. 9*a* shows in diagrammatic side elevation one gripping device 24 from FIG. 1. Each gripping device 24 is suspended from a rod 96 (also seen in FIG. 1). The rod 96 is fixedly mounted in the frame 26 parallel to the longitudinal direction of the belt 22 Each gripping device 24 is rotatable about the longitudinal axis of the rod 96. A selectively pressurizable cylinder-and-piston unit 98 (FIG. 1) is provided to rotate the gripping devices 24 together about the rod 96. The cylinder-and-piston unit 98 extends between and is secured to the frame 26 and a lever 100 (FIG. 9—also visible in FIG. 1) rotatable on and extending radially outwardly from the rod 96. The lever 100 has an extension 101 (FIG. 9 carrying a bar 103 extending parallel to the belt 22 past all four gripping devices 24 (not visible in FIG. 1). Each gripping device 24 comprises a pair of legs 102, 104 respectively mounted on and extending away from the rod 96. Each leg 102 and 104 comprises a respective mounting part 102*a*, 104*a* mounted on the rod 96 for rotation thereon about the axis of the rod 96. Each leg 102 and 104 further comprises an intermediate part 102*b* or 104*b* rigidly secured to the respective mounting part 102*a* or 104*a* via fixing plates 106. Each leg 102 and 104 further comprises a respective package engaging part 102*c* and 104*c* secured to the respective intermediate part 102*b* or 104*b* by way of a respective pivot mounting arrangement 108 the function and operation of which are essentially the same as thereof the pivot mounting arrangement 62 shown in FIG. 4. Finally, a selectively pressurizable cylinder-and-piston unit 110 extends between the plates 106 and functions in the same way as the cylinder-and-piston unit 56 shown in FIG. 3, that is, to open and close the gripping device 24. For simplicity of illustration, the details of these leg structures have been omitted from the diagrams in FIG. 9*b* and 9*c*.

FIG. 9*a* shows the removal system in its starting position with the frame 26 raised to the upper limit position and with the cylinder-and-piston unit 98 fully extended so that the bar 103 leaves each gripping device 24 free to pivot under its own weight to a substantially vertical disposition as also shown in FIG. 1. FIG. 9*c* also shows a package 16 which has been aligned with the illustrated gripping device 24 as previously described with reference to FIGS. 1 to 5. The package 16 is illustrated with its smaller end facing the stop 40, but this is unimportant to the operation of the removal system, because the pivot mounting arrangements 108 (FIG. 9*a*) permit each gripping device 24 to adjust automatically to the package orientation set by the control system. When the control system issues a starting signal, following receipt of a correct combination of signals from the detectors 92 and 94 as described above, a frame drive system (not shown) arranged in the column 34 is operated to move the frame 26 downwardly relative to the columns 30 and 34, thus carrying the rod 96 down to the position shown in FIG. 9*b*. During this movement, the cylinder of the unit 98 (FIG. 1) is pressurized to retract the connecting rod of this unit 98, and thus to rotate the bar 103 about the axis of the rod 96 as viewed in FIGS. 1 and 9. The bar 103 engages the legs 102 and carries the gripping devices 24 with it around the rod 96, but this rotational movement is limited so that the free end of each leg 102 remains to the left (as viewed in FIG. 9) of an imaginary plane indicated at 114 so long as the gripping device 24 is situated at a higher elevation than the package 16. This plane 114 represents the closest possible approach of any point on the outer envelope of the package 16 to the path of movement 116 of the axis of the rod 96. The above desired movements are complete before the gripping device 24 has moved down to the level of the package 16. The rod 96 continues to move downwardly until the gripping devices 24 have reached the disposition shown in FIG. 9*b* and also thereafter. The free end of the package engaging part 102*c* of the leg 102 thus moves past the package 16 and engages a guide plate 113 projecting from the framework which supports the belt 22. As the downward movement of the rod 96 continues, the end of the leg 102 is guided by the plate 113 into the converging space or nip between the package 16 and the belt 22 (see FIG. 9*c*. When the leg 102 has been introduced into this converging space or nip to the desired extent, the movement of the rod 96 along its path 116 is stopped, and the unit 110 (FIG. 9*a*) is operated to close the legs 102, 104 on the package 16. A positioning sensor (not shown) can be used to cause the stoppage of the rod 96 and the closing of the gripping device 24 at a predetermined position of the rod 96 along its path 116. When the package 16 is firmly grasped, the rod 96 is raised once more and the gripping device 24 is allowed to pivot back to its substantially vertical position. In the course of this movement, the package 16 is first lifted clear of the belt 22, and then carried to one side of the belt 22 by the pivotal movement of the gripping device 24. The frame 26 can then be lowered in order to carry the complete group of four grasped packages 16 into the receiver carriage waiting underneath the bridge structure.

As already described above, each row of four packages 16 accumulated on the belt 22 is to be formed with the packages 16 oriented in the same direction and for this purpose the unit 38 has to carry out on each package 16 a predetermined sequence of operations. This sequence is represented by the flow chart shown in FIG. 6. The sequence shown in FIG. 6 is triggered by a signal from the detector 90 indicating the arrival of a package 16 in the sensing zone. The control system then issues a command to stop the belt 22, this operation being represented by the block 118 in FIG. 6. When this operation is correctly completed, the control system issues a further command to close the arms 46 and 48, this operation being represented by the block 120. The control system now directs further operations into one of two routines represented respectively by the branches 124 and 126 leaving the block 122 The block 122 represents a decision by the control system whether the currently forming row of packages 16 is to be made up with the packages 16 in the "0" orientation (route 124) or the "180" orientation (route 126). In order to explain these latter expressions, and the background to the decision processes represented by the two branches in FIG. 6, reference will now be made to FIG. 7 which shows again in still more diagrammatic form certain mechanical elements referred to above.

The arrow 128 on the left hand side of FIG. 7 represents the longitudinal direction of the belts 14, 22 with the arrow head pointing in the downstream direction, that is, towards the stop 40 shown in FIG. 1. A package orientation represented at 130 near the arrow head, that is with the smaller package end facing towards the stop 40, is designated the "0" orientation. A package orientation 132 shown near the foot of the arrow, that is with the larger package end facing towards the stop 40, is designated as the "180" orientation. The designations are purely arbitrary, for the purpose of description only, and have no significance in relation to the invention, except to facilitate its explanation.

The upper diagram FIG. 7*a* shows diagrammatically two possible arrangements of the arms 46 and 48 and the cylinder-and-piston unit 86. In both arrangements, the unit 86 is fully extended as indicated on the right hand side of the diagram. Assume, for purposes of illustration, that the indicating element 66 (and of course the proximity sensor 64, not shown in FIG. 7) are located at the front of the unit 38, that is closer to the stop 40. As already described, the arm 46 is maintained in a fixed orientation during sensing of orientation of the package 16; in FIG. 7*a* this arm 46 is assumed to lie parallel to a longitudina; belt direction 128. The arm 48 can, however, adopt one of two possible orientations depending upon the orientation (130 or 132) of the package 16 being sensed. In one arrangement shown in full lines in FIG. 7*a*, the front end of the arm 48 is closer to the arm 46, corresponding to the "0" orientation 130 of a sensed package 16. In the second arrangement, illustrated in dotted lines in FIG. 7*a*, the rear end of the arm 48 is closer to the arm 46, corresponding to the "180" orientation 132 of a sensed package 16. FIG. 7*b* illustrates two further possible arrangements of the parts 46, 48 and 86. In both these arrangements, the unit 86 is fully retracted so that the indicator element 66 is now at the rear of the unit 38. Again, the arm 46 is arranged parallel to the belt direction 128 and the arm 48 can adopt two dispositions (indicated in full lines and dotted lines respectively) corresponding respect ively to the "180" and "0" orientations 132 and 130 of the sensed package 16. Examination of FIG. 7 will show that, in the illustrated embodiments the control system must make two decisions in the ourse of each orientation sensing operation, namely whether the end of the arm 48 which carries the element 66 is closer to or further away from the arm 46 (that is, whether the element 66 is close to or spaced from the proximity sensor 64) and whether the element 66 is at the front (FIG. 7*a*) or at the rear (FIG. 7*b*) of the unit 38, that is,whether the unit 86 is extended or retracted. A suitable sensor (not shown) is associated with the unit 86 in order to provide an output signal to the control system upon the basis of which the latter decision can be made.

Consider now route 124 in FIG. 6; this route calls for the "0" orientation 130 (FIG. 7). The first decision (represented by a block 134) is whether the unit 38 is facing fron (unit 86 extended—condition FF, FIG. 7*a*) or facing rear (unit 86 retracted—condition FR, FIG. 7*b*). If the control system finds that unit 38 is facing frontwardly, then it proceeds to the decision represented by a block 136, namely whether the sensed package 16 is aligned with the unit 38 ( element 66 spaced from the proximity sensor 64—condition A in FIGS. 7*a* and 7*b*) or reversed relative to the unit 38 (element 66 adjacent the proximity sensor 64—condition R in FIGS. 7*a* and 7*b*). It will be realized that each of the expressions "facing front", "facing rear", "aligned" and "reversed" is purely arbitrary and has been selected merely for purpose of identification of different possible conditions in this description. If the decision 136 is that the package 16 is aligned with the unit 38, then a signal representing this "positive" outcome is stored, this operation being indicated by a block 138 in FIG. 6. If the decision 134 is that the unit 38 is facing rear, or if the decision 136 is that the package 16 is reversed relative to the unit 38, the control system proceeds immediately to a decision represented by a block 140, to which it also proceeds after the storage operation represented by the block 138. The block 140 represents a second decision as to whether the unit 38 is facing frontwardly or facing rearwardly. If the unit 38 is facing rearwardly, the control system proceeds to a block 142 where a decision is made whether the sensed package 16 is aligned or reversed relative to the unit 38. If the package 16 is reversed, a signal representing this "positive" outcome is stored as indicated by a block 144. If the decision 140 is that the unit 38 is facing frontwardly, or the decision 142 is that the package 16 is aligned relative to the unit 38, the control system proceeds immediately to the decision represented by a block 146, to which it also proceeds after the storage operation indicated by the block 144. In the operation represented by the block 146, the control system examines the results of the decisions 136 and 142, that is,the control system examines the conditions of the stores representing the outcomes of those decisions. A comparison of FIG. 6 with FIG. 7 will show that a "positive" outcome of either of the decisions 136 and 142 means that the sensed package 16 is in the desired orientation. Accordingly, if the control system finds the appropriate stored signal during the operation 146, it proceeds to the operations represented respectively by blocks 148 and 150, namely opening of the arms 46 and 48 to release the package 16 (block 148 and restarting the belt 22 in order to move correctly oriented package 16 out of the sensing zone (block 150). If the operation 146 indicates a negative outcome of both of the decisions 136 and 142, then the control system proceeds to a series of operations represented as a group by a block 152. These operations include the previously mentioned lifting of the unit 38 in order to move the sensed package 16 clear of the belt 22, sensing the current condition of the unit 86 and reversal of that condition, and lower ing the unit 38 in order to return the oriented package 16 onto the belt 22. After the completion of the operation group 152, the control system proceeds to operations 148 and 150 already described.

In view of the detailed description of the route 124, it is believed that the succession of steps included in the route 126 will be readily understood with a relatively brief description of the blocks shown therein. Blocks 154 and 160 represent decisions whether the unit 38 is facing frontwardly or facing rearwardly. Blocks 156 and 162 represent decisions whether the package 16 is aligned or reversed relative to the unit 38. Block 158 rerepresents storage of a "positive" outcome of the decision 156 and block 164 represents storage of a "positive" outcome of the decision 162. Block 166 represents a search for a "positive" outcome to either one of the decisions 156 and 162. The control proceeds from the decision 154 to the decision 156 if the unit 38 is found to be facing rearwardly, and from the decision 160 to the decision 162 if the unit 38 is found to be facing frontwardly. The outcome of the decision 156 is "positive" if the sensed package 16 is found to be aligned with the unit 38 and the outcome of the decision 162 is "positive" if the package 16 is reversed relative to the unit 38.

The control system switches between the routes 124 and 126 in dependence upon signals it receives representing the current condition of a carriage moving system which will be briefly described with reference to FIG. 1. Attached to the end unit 10 at ground level 28 is a horizontally elongated housing 168 disposed at right angles to the length of the machine and to the direction of movement of the belts 14 and 22. An arm 170 projects from the housing 168 and is mounted on a bar 172 extending longitudinally of the housing 168 underneath the bridge structure. At its opposite end (hidden in FIG. 1 by the pier 32) the bar 172 car ries a second arm 170 projecting therefrom in the same manner as the discussed arm 170. The bar 172 is rotatable about its own longitudinal axis so as to move the arms 170 between upright positions illustrated in FIG. 1 and lowered positions in which the arms 170 extend substantially in the direction of movement of the belts 14 and 22. In their upright positions, the arms 170 do not interfere with the movement of a package receiving carriage into the space between the housing 168 and the pier 32. When the carriage has been suitably located relative to the bridge structure by a machine attendant, the bar 172 can be rotated to bring the arms 170 into their lowered positions in which they engage respective opposite ends of the carriage. The bar 172 can now be controllably reciprocated by a suitable driving means (not shown) longitudinally of the housing 168, thereby moving the carriage in a controlled fashion in directions transverse to the direction of movement of the belts 14 and 22.

The drive for reciprocating the bar 172 is preferably settable so that the bar 172 (and a carriage) can be caused to move along the housing 168 in a series of equal steps. The length of each step is dependent upon the maximum diameter of the package 16 to be layed in the carriage. The number of steps which together make up a full stroke of the bar 172 in any given direction will be dependent upon the number of parallel rows of packages 16 which are to be layed in the carriage to make up single layer therein. Each row is of course deposited in the carriage with the package axes extending parallel to the machine and belt direction, and the carriage is moved through one step after deposition of each row of a given layer in order to prepare it to receive the next row of the same layer. The arrangement is preferably set up so that deposition of packages 16 starts at one end of the carriage and proceeds, with stepping of the carriage until one complete layer has been deposited. A counter (not shown) is provided to register the number of steps through which the carriage is moved. Throughout this stage (deposition of the first layer) the control system selects either the route 124 or the route 126, without changing its original selection For convenience, assume that the route 124 is first selected, so that all packages of the first layer are deposited in the "0" orientation. When the counter indicates completion of the deposition of the first layer, the control system switches ( in the assumed example) from the route 124 to the route 126 so that the packages 16 of the second layer will be deposited in the "180" orientation. The carriage is caused to move a half step in reverse before the first row of the second layer is deposited; thereafter, the carriage steps in reverse until the second layer has been deposited with one less package row than in the first layer. The system reversal is then repeated for deposition of the third layer, and so on until the carriage is full. A proximity sensor (not shown) can be provided in conjunction with one or more of the gripping devices 24, and this sensor can be linked to the control system for moving the frame 26, so that lowering of the frame 26 is stopped when the packages 16 of the row being deposited are spaced only slightly above the surface upon which they are to be deposited (either the floor of the carriage or the packages 16 of the layer below them). The reference numeral 174 in FIG. 1 represents an additional light barrier sensor sending a beam across the carriage path between the pier 32 and the column 30, so that deposition operations cannot be carried out in the absence of a carriage from the carriage path, which otherwise breaks the light barrier beam.

The invention is not limited to details of the illustrated embodiment. The sensing/orienting unit 38 could be associated with the end portion of the main transport belt 14 instead of the infeed portion of the auxiliary belt 22. In this case, the main transport belt 14 may have to be stopped briefly in order to enable the sensing/orienting unit 38 to grasp a package. However, this would not represent serious interference with the overall operation of the machine if, e.g., the main transport belt 14 is to be stopped in any event during a doffing operation at one of the machine processing stations. Furthermore, the sensing/orienting unit 38 could be associated with an intermediate conveyor between the main conveyor 14 and the accumulator conveyor 22. In this case, it would be possible to operate the accumulator conveyor 22 in the manner disclosed in the U.S. patent application No. 510,557, so as to avoid slippage between the accumulator conveyor 22 and the outer windings of the packages 16 supported thereon.

The conveyors 14 and 22 do not have to be in the form of belts or bands. The auxiliary conveyor 22 in particular could be made up of a plurality of parallel rollers, selected rollers being drivable into rotation about their own longitudinal axes to cause movement of a package 16 along the conveyor 22. Drivable rollers could, e.g., be provided in the sensing zone referred to above, and also at the infeed to the accumulating zone. While the rollers in the main part of the accumulating zone should be mounted for rotation around their longitudinal axes, they would not have to be externally driven.

The exact sequence of operations carried out by the unit 38 can be altered to fit the desired operating circumstances; for example, the unit 38 could be turned back to face frontwardly after each package orienting operation; in this case, the control sequence described with reference to FIG. 6 could be simplified by eliminating the decision regarding the current orientation of the unit 38. However, the control system would then have to be modified to ensure that a new package 16 is not fed into the sensing zone until the return movement of the unit 38 has been completed.

The invention is not limited to use with any particular removal and/or deposition system. For example only, the frame 26 carrying the gripping devices 24 could be movable horizontally to a position above the belt 22, and the gripping devices 24 could then simply be lowered in order to grasp a group of packages 16 accumulated on the belt 22. Such an arrangement would, however, take up more space above the belt 22. If required, one package engaging arm 46 or 48 of the unit 38 could be fixed and the other could be movable towards and away from it to close the package gripper. Either arm 46 or 48 could carry the portion which adapts to the package conicity. The arm suspension can be similar to the suspension of the legs as shown in FIG. 9 a; that is with both arms 46 and 48 pivotable on a common axis. Alternatively, the package engaging members 46 and 48 could be linearly movable to open, close the gripper.

The control means is preferably a programmable controller, but any control system adapted to carry out the described sequence of operations can be used. Such devices are well known in the art so that they need not be discussed here in any great detail.

The sensor means responding to the position of the part 60 is not necessarily a proximity sensor. Any other sensor (preferably contactless) suitable for detecting the presence of a mechanical part in a given disposition could be substituted. A proximity sensor is preferably magnetic, but could for example be pneumatic or electrostatic.

In the removal system, the legs 102 and 104 of each of the gripping devices 24 could be pivotable about respective pivot axes instead of about a common axis. With additional modification in the control system for controlling the movements of the legs, the movement of the leg 102 into the space between the package 16 and the belt 22 could be effected by controlled pivoting of the leg.102 by means of a power drive therefor, eliminating the mechanical engagement with the plate 113. Where the latter is provided, the gripping device 24 holding the full package must be able to pass by the outer edge of the plate 113 as the gripping device 24 moves down into the carriage.

The machine arrangement briefly described with reference to FIG. 2 can be seen in further detail in our copending British Patent Application No. 83133994 and the full dislosure of which is also incorporated herein by reference.

It will be understood that each of the elements described above, or two or more together, may also find a useful application in other types of arrangements differing from the type described above.

While the invention has been illustrated and described as embodied in an arrangement for handling conical thread packages, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art, and, therefore, such adaptations should and are intended to be comprehended within the meaning and range of equivalence of the claims.

What is claimed as new and desired to be protected by Letters Patent is set forth in the appended claims.

1. An arrangement for handling articles, especially thread packages, which are so configured as to permit distinguishing between at least two opposite orientations thereof, comprising main conveyor means for conveying the articles in a predetermined direction in a conveying path such that each article arrives at the downstream end of said main conveyor means with an arbitrary one of said opposite orientations, auxiliary conveyor means arranged at said downstream end for receiving the articles in succession from said main conveyor means; means for sensing the orientation of the articles at the juncture of said main and auxiliary conveyor menas; means for manipulating only any such article whose orientation at said juncture as sensed by said sensing means is opposite to a desired orientation which such article is to assume on said auxiliary conveyor means downstream of said manipulating means to give such article such desired orientation which is predetermined for the respective article and different for different articles, said manipulating means including a pair of article-engaging members at least one of which has at least a portion arranged to adopt respective disposition in dependence on the orientation of the article engaged by said manipulating means with respect to the arrangement and said sensing means being operative for sensing the disposition of said porition; and selectively operable means for displacing said article-engaging members in engagement with the article for changing the orientation of the article is requried to acheive said desired orientation.

2. The arrangement as defined in claim 1, wherein said auxiliary conveyor means is arranged to form a continuation of said main conveyor means in said predetermined direction.

3. The arrangement as defined in claim 1, wherein said sensing means is incorporated in said manipulating means.

4. The arrangement as defined in claim 1, and further comprising means for so controlling the operation of said manipulating means in dependence on signals received from said sensing means that all articles of a row formed on said auxiliary conveyor means have the same orientation.

5. The arrangement as defined in claim 1, wherein. said sensing and manipulating means are so disposed as to sense the orientation of the respective article and change it to the desired orientation if need be only after the respective article has been transferred from said main conveyor means onto said auxiliary conveyor means.

6. The arrangement as defined in claim 1, and further comprising means for so controlling the operation of said manipulating means as to selectably vary the desired orientation which the articles are to assume on the auxiliary conveyor means downstream of said manipulating means.

7. The arrangement as defined in claim 1, wherein said auxiliary conveyor means is operative for accumulating a group of the articles with the desired orientations thereon; and further comprising means for simultaneously removing such group from said auxiliary conveyor means.

8. The arrangement a defined in claim 1 for use in depositing the articles in an ordered fashion into a respective receiving container, and further comprising means for supporting the receiving container at the region of said auxiliary conveyor means; and means for controlledly moving the receiving container with respect to said auxiliary conveyor means.

9. The arrangement as defined in claim 1, wherein said auxiliary conveyor means is operative for accumulating a group of the articles with the desired orientations thereon; further comprising means for simultaneously removing such group from said auxiliary conveyor means, and means for so controlling said removing and moving means as to deposit in a receiving container superimposed layers of the articles, and said manipulating means as to change said desired orientation from one of said layers to another.

10. The arrangement as defined in claim 1, wherein said article-engaging members are mounted for joint movement about an axis transverse to an axis of the article; and wherein said displacing means is operative for jointly angularly moving said article-engaging members about said transverse axis.

11. The arrangement as defined in claim 1, wherein said article-engaging members are mounted for movement together and apart in a given direction; and wherein said portion is mounted on the remainder of said one article-engaging member for pivoting about an axis transverse to said given direction.

12. The arrangement as defined in claim 1, wherein said sensing means includes a proximity sensor responsive to the presence of said portion in one of said dispositions.

13. An arrangement for handling articles, especially thread packages, which are so configurated as to permit distinguishing between at least two opposite orientations thereof, comprising main conveyor means for conveying the articles in a predetermined direction in a conveying path such that each article arrives at the downstream end of said main conveyor means with an arbitrary one of said opposite orientations; auxiliary conveyor means arranged at said downstream end for receiving the articles in succession from said main conveyor means; means for sensing the orientation of the articles at the juncture of said main and auxiliary conveyor means; means for manipulating only any such article whose orientation at said juncture as sensed by said sensing means is opposite to a desired orientation which such article is to assume on said auxiliary conveyor means downstream of said manipulating means to give such article such desired orientation; and means for removing the articles from said auxiliary conveyor means, including article-engaging members, means for mounting said article-engaging members for movement together and apart and for pivoting about an axis, including a carrier mounted to one side of said auxiliary conveyor means for movement substantially transversely to the plane of said auxiliary conveyor means and carrying said axis of pivoting, means for displacing said article-engaging member about said pivoting axis and moving said carrier in said path for at least one of said article-engaging members to engage the respective article at a region situated at the surface portion of the article which faces said auxiliary conveyor means, and abutment means arranged to contact said one article-engaging member and deflect the same before reaching said auxiliary conveyor means.

14. The arrangement as defined in claim 1, and further comprising means for storing data as to the desired orientations of the articles to be arranged on said auxiliary conveyor means; and control means for controlling the operation of said manipulating means in dependence on the output of said sensing means and the output of said storing means at any given time to obtain the desired orientations for the articles on said auxiliary conveyor means downstream of said manipulating means.

15. The arrangement as defined in claim 14, wherein said control means is operative for causing said manipulating means to change the orientation of the respective article through 180° about an axis transverse to a longitudinal axis of the article if needed to arrive at said desired orientation in conformity with said data.

16. An installation for transporting conical thread packes, comprising conveying means for moving packages in succession along a predetermined path; means for halting each package at a package orientation station by temporarily terminating at said station the conveying action exerted on the respective package by said conveying means, and a package orienting unit disposed above said conveying means at said station, including a pair of package engaging members movable between a first relative disposition thereof in which said package engaging members are situated outside said predetermined path so as not to interfere with the movement of the respective package into and out of the station, and a second relative disposition in which said package engaging members engage the respective package at said station at opposite sides of the respective package, a package orientation sensor carried by at least one of said package engaging members and operative for sensing the orientation of the respective package engaged by said package engaging members, selectively operable means for raising and lowering said package engaging members to lift the respective package which is engaged thereby clear of said conveying means and to return such package to said conveying means, and means for rotating said package engaging members in their raised position to reverse the orientation of the respective package engaged thereby.

17. The installation as defined in claim 16, wherein each of said package engaging members has a curved portion which engages the respective package from below at said station as said package engaging member approach said second relative disposition thereof.

18. The installation as defined in claim 16, wherein at least one of said package engaging members has a portion pivotable between a first disposition and a second disposition thereof in dependence on the orientation of the respective package engaged by said one package engaging member; and wherein said sensing means is operative for sensing the disposition of said portion of said one package engaging member after said one package engaging member has been brought into engagement with the respective package.

19. The installation as defined in claim 16; further comprising a support member; wherein said package engaging members are mounted on said support member for movement relative thereto; and wherein said lifting and rotating means acts on said support member.

20. The installation as defined in claim 19, wherein said package engaging members are mounted on said support member for pivoting relative thereto.

21. The installation as defined in claim 16, wherein said conveying means includes a first and a second package conveyor which are operable independently of one another; and wherein said station is located at said second conveyor such that the respective package enters the station shortly after its transfer from said first to said second conveyor.

22. The installation as defined in claim 21, and further comprising means for sensing the accumulation of a group of the packages on said second conveyor, and means for simultaneously removing the packages of the group from said second conveyor.

23. The installation as defined in claim 16, wherein said sensing means includes a first sensing device for sensing the orientation of the respective package relative to said orientation unit, and a second sensing device for sensing the position of said orientation unit with respect to said conveying means.

24. The installation as defined in claim 16, and further comprising control means for controlling the operation of said orientation unit in response to the orientation of the respective package as sensed by said sensing means and to selectively variable data input representing a desired orientation for the respective package which is then halted at said station.

25. The installation as defined in claim 24, and further comprising means for depositing the packages in their desired orientations in a predetermined array, and means for supplying to said control means a data input indicative of the orientation required for the respective package to form the array.

26. An installation for transporting conical thread packages and depositing such packages in a predetermined array, comprising conveying means for moving the thread packages in succession along a predetermined path and for halting each package in succession at a package orientation station arranged at said path by temporarily terminating the conveyance of the respective package at said station; means for sensing the orientation of the respective package halted at said station; selectively operable means for reversing the orientation of the respective package halted at said station; means for receiving oriented packages downstream of said station and for forming such oriented packages into a predetermined array; means for generating a signal representative of the orientation required of the respective package halted at said station for inclusion in said array; and control means responsive to said sensing means and to said signal generated by said generating means and operative for actuating said reversing means if required to provide the respective package halted at said station with orientation repersented by said signal.

27. The installation as defined in claim 26, wherein said receiving means comprises means for removing said packages from said conveying means and for placing such removed packages on a support, and means for moving the support relative to said removing means; and wherein said signal generating means is responsive to the operation of said support moving means.

28. The installation as defined in claim 27, wherein said support moving means is reversible to move the support back and forth relative to said removing means; and wherein said signal generating means is operative for reversing the required package orientation whenever the movement of the support is reversed.

29. The installation as defined in claim 27, and further comprising means for sensing the accumulation of a group of oriented packages on said conveyor means; and wherein said control means is responsive to the sensing of the accumulation of the respective group of packages for causing said removing means to remove all packages of the respective group simultaneously.

* * * * *